United States Patent [19]

Lawson

[11] 4,427,072

[45] Jan. 24, 1984

[54] METHOD AND APPARATUS FOR DEEP UNDERWATER WELL DRILLING AND COMPLETION

[75] Inventor: John E. Lawson, London, England

[73] Assignee: Armco Inc., Middletown, Ohio

[21] Appl. No.: 380,910

[22] Filed: May 21, 1982

[51] Int. Cl.[3] ..... E21B 7/12; E21B 43/01

[52] U.S. Cl. ..... 166/345; 166/366; 166/368; 175/7

[58] Field of Search ..... 166/344, 345, 366, 368; 175/5, 7; 405/169, 225, 227

[56] References Cited

U.S. PATENT DOCUMENTS

| | | | |
|---|---|---|---|
| 2,891,770 | 6/1959 | Bauer et al. | 255/1.8 |
| 3,017,934 | 1/1962 | Rhodes et al. | 166/350 |
| 3,221,506 | 12/1965 | Stratton et al. | 61/46.5 |
| 3,366,173 | 1/1968 | McIntosh | 166/0.5 |
| 3,504,741 | 4/1970 | Baker et al. | 166/0.5 |
| 3,517,735 | 6/1970 | Fairbanks et al. | 166/0.5 |
| 3,618,661 | 11/1971 | Peterman | 166/0.5 |
| 3,881,549 | 5/1975 | Thomas | 166/0.5 |
| 3,934,658 | 1/1976 | Nelson | 175/7 |
| 4,095,649 | 6/1978 | Chateau et al. | 166/0.5 |
| 4,170,266 | 10/1979 | Fayren | 175/7 |
| 4,175,620 | 11/1979 | Nolan, Jr. et al. | 166/343 |
| 4,216,835 | 8/1980 | Nelson | 175/10 |
| 4,228,857 | 10/1980 | Nobileau | 166/341 |

*Primary Examiner*—Ernest R. Purser
*Assistant Examiner*—Thuy M. Bui
*Attorney, Agent, or Firm*—Roylance, Abrams, Berdo & Goodman

[57] ABSTRACT

A method and apparatus for remotely establishing an underwater well under conditions of great water depth including a drilling guide structure located on the floor of the body of water; a single handling and guiding string extending upwardly from the drilling guide structure and maintained in tension by an elongated buoy; a series of drilling guide arm units, flowline guide arm units and wellhead guide arm units to be lowered down the string, oriented relative to desired well positions and then retrieved once the wells have been drilled and the wellheads and flowlines secured in place; and a production gathering assembly to be lowered down the string, oriented relative to the wellheads and flowlines, and then coupled to these wellheads and flowlines. The orientation is accomplished between an orientation member on the outer surface of a tubular member extending upwardly from the guide structure and orientation members on the inner surfaces of open-ended members in the drilling guide arm units, flowline guide arm units, wellhead guide arm units and the production gathering assembly.

12 Claims, 12 Drawing Figures

METHOD AND APPARATUS FOR DEEP UNDERWATER WELL DRILLING AND COMPLETION

FIELD OF THE INVENTION

The invention relates to a method and apparatus for remotely establishing an underwater well under conditions of greater water depth. The invention includes provision for remotely drilling a plurality of wells and installing casing therein with the use of a drilling guide structure at the floor of the body of water, landing a plurality of cross-over flowline assemblies between the casing and guide structure, landing a plurality of wellheads on the casing in the drilled wells, and landing a production gathering assembly on the guide structure to connect the wellheads to a production vessel at the surface of the body of water. These remote operations are carried out by sequentially lowering and retrieving drilling guide arm units, flowline guide arm units, and wellhead guide arm units to and from the guide structure and finally lowering the production gathering assembly to the guide structure. These lowering operations take place along a single handling and guiding string extending from the guide structure and tensioned by a subsurface buoy.

BACKGROUND OF THE INVENTION

As the search for underwater oil and gas deposits continues, wells at great depths are being drilled and installed. Of course, these operations, taking place at greater than, for example, 1000 feet below the water surface, require very complicated and costly equipment. For example, in attempting to establish wells in very deep water, numerous guide lines are usually used as are rigid vertical and horizontal structures, which are heavy, cumbersome and expensive. In addition, in constructing such deep underwater wells, there are numerous difficulties in remotely manipulating various elements to drill and then complete the well.

Examples of some of the prior art devices utilized in such drilling and completion operations are disclosed in the following U.S. Pat. No. 2,891,770 to Bauer et al; U.S. Pat. No. 3,017,934 to Rhodes et al; U.S. Pat. No. 3,221,506 to Stratton et al; U.S. Pat. No. 3,366,173 to McIntosh; U.S. Pat. No. 3,504,741 to Baker et al; U.S. Pat. No. 3,517,735 to Fairbanks et al; U.S. Pat. No. 3,618,661 to Peterman; U.S. Pat. No. 3,881,549 to Thomas; U.S. Pat. No. 3,934,658 to Nelson; U.S. Pat. No. 4,095,649 to Chateau et al; U.S. Pat. No. 4,170,266 to Fayren; U.S. Pat. No. 4,175,620 to Nolan, Jr. et al; U.S. Pat. No. 4,216,835 to Nelson; and U.S. Pat. No. 4,228,857 to Nobileau.

SUMMARY OF THE INVENTION

Accordingly, a primary object of the invention is to provide a method and apparatus for remotely establishing an underwater well under conditions of great water depth.

Another object of the invention is to provide such a method and apparatus that requires a minimum amount of relatively simple equipment and is relatively low in cost.

Another object of the invention is to provide such a method and apparatus that can establish such an underwater well utilizing a single, tensioned handling and guiding string without the need for a multiplicity of guide lines and without the need for large vertical towers or horizontal templates.

The foregoing objects are basically attained by following the method comprising the steps of installing at the floor of the body of water a generally upright support rigidly secured in the floor and projecting upwardly thereform, lowering a drilling guide structure onto the upright support with a single handling string, vertically orienting the drilling guide structure, locking the drilling guide structure to the upright support in the vertical position, lowering along the single handling string a drilling guide arm unit carrying a drilling string and bit onto the drilling guide structure, orienting the drilling bit with a desired well location by coacting the drilling guide arm unit with the drilling guide structure, and drilling a well so oriented with the drilling bit.

The second lowering, the orienting and the drilling steps are repeated for additional wells.

After wellhead casing is installed in the well and the drilling string, drilling bit and drilling guide arm unit are retrieved to the surface, the method continues and comprises the steps of lowering along the single handling string a flowline guide arm unit carrying a flowline assembly onto the drilling guide structure, orienting the flowline assembly with the well casing corresponding to the drilled well by coacting the guide arm unit with the drilling guide structure, coupling the flowline assembly to the well casing and the guide structure, and retrieving the guide arm unit to the surface for use with additional flowline assemblies.

Next, the method continues with the lowering and orienting of wellheads on wellhead guide arm units, each wellhead being coupled to a well casing and a flowline assembly.

At that time the method continues and comprises the steps of lowering along the single handling string a production gathering assembly having flowline risers extending upwardly therefrom and flowline connectors extending downwardly thereform, orienting the production gathering assembly and flowline connectors with the flowline assemblies by coacting the production gathering assembly with the drilling guide structure, and coupling the flowline connectors to the flowline assemblies.

The upwardly extending flowline risers are then coupled to, for example, a production vessel at the surface of the body of water, thereby completing a flow connection between the deposit of oil or gas in the wells and the surface of the body of water.

Other objects, advantages and salient features of the invention will become apparent from the following detailed description which, taken in conjunction with the annexed drawings, discloses a preferred embodiment of the invention.

DRAWINGS

Referring now to the drawings which form a part of this original disclosure:

Figure 10:
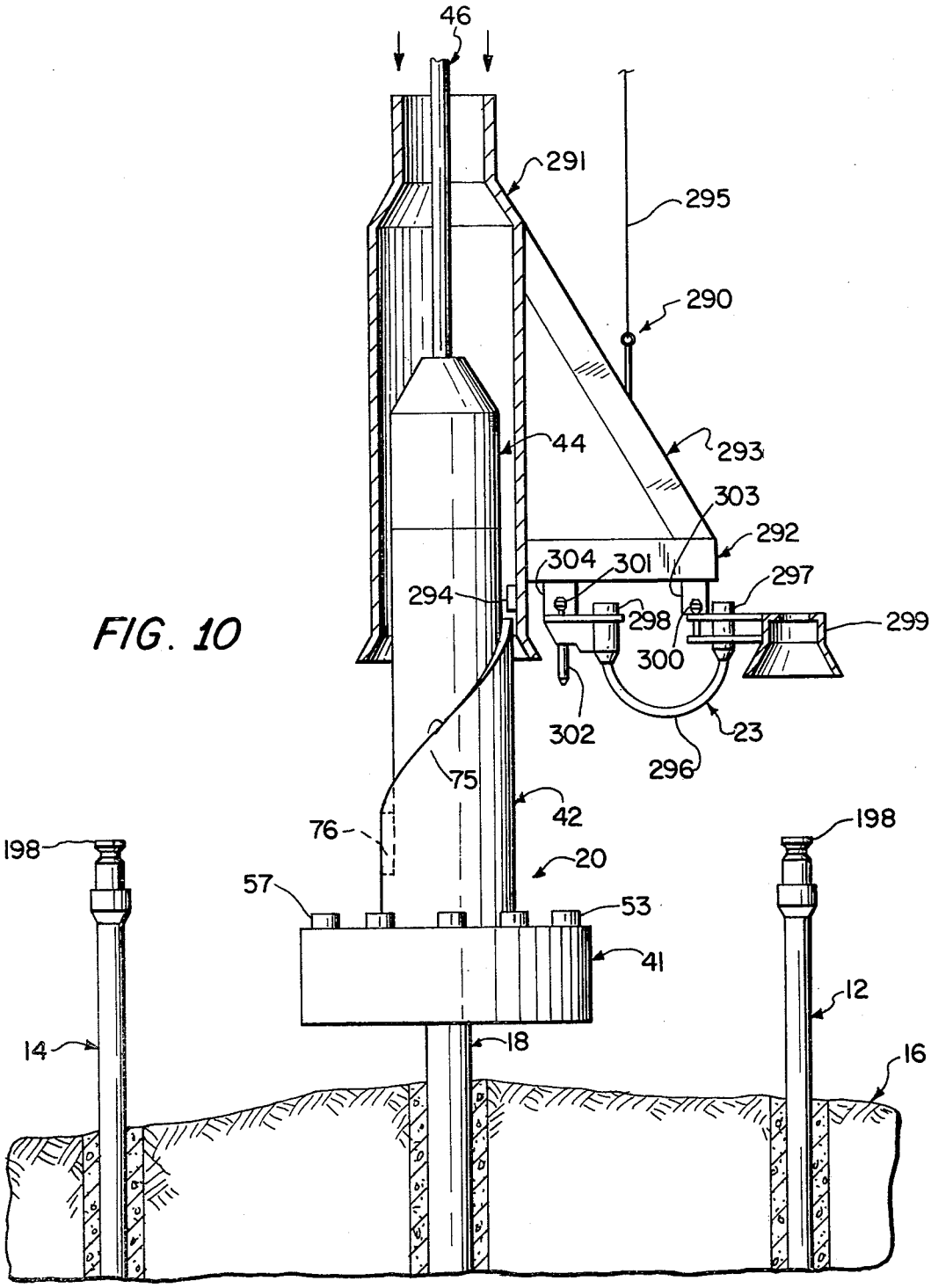
FIG. 10 is a diagrammatic elevational view with parts in section of a flowline guide arm bit being lowered along the handling and guiding string and about to be landed on the drilling guide structure, the unit carrying a flowline assembly.
Figure 11:
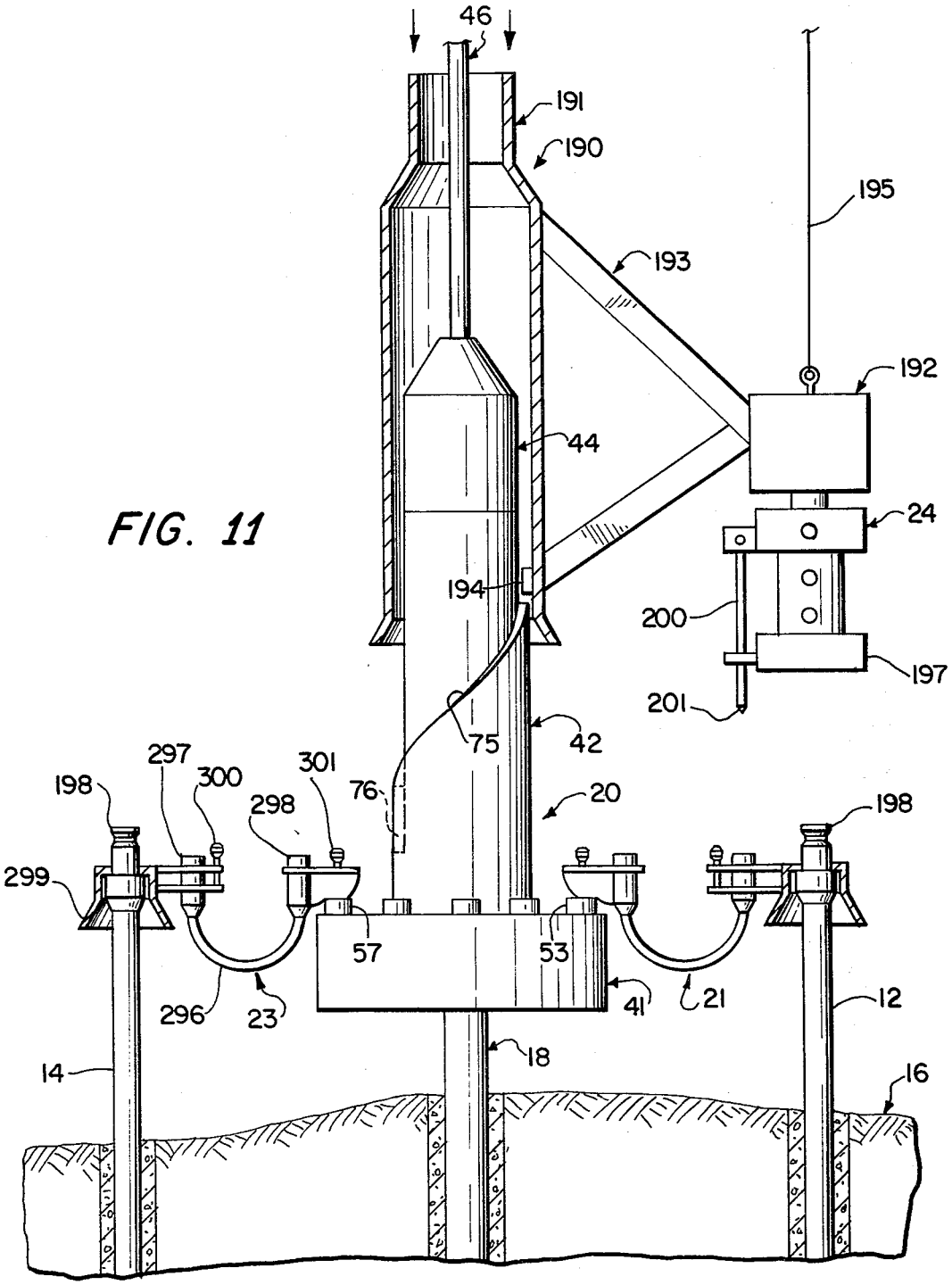
Figure 12:
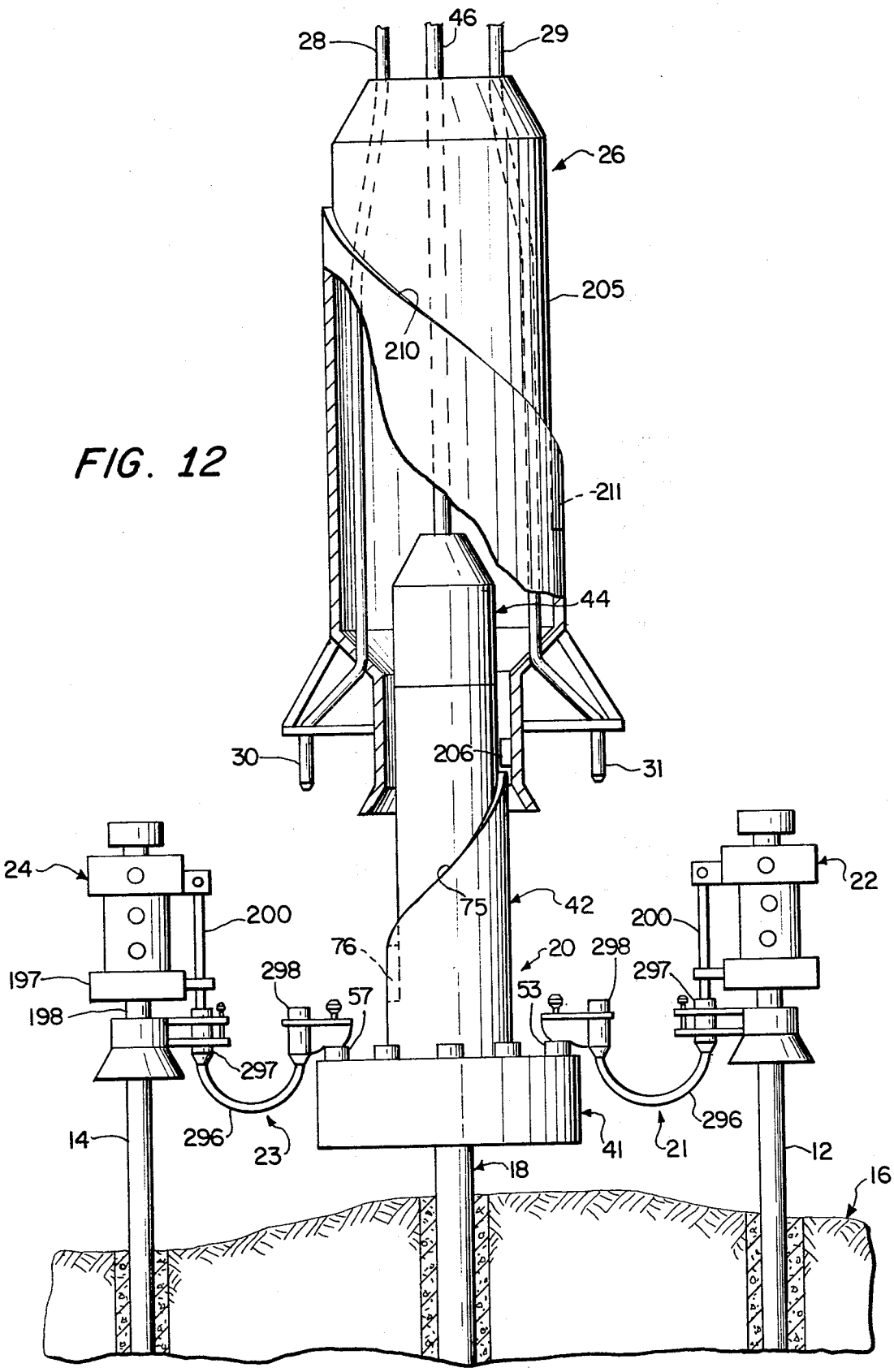

FIG. 11 is a diagrammatic elevational view similar to that shown in FIG. 10 except that the flowline guide arm unit has landed two flowline assemblies on the drilling guide structure and the well casings, and a wellhead guide arm unit is being lowered along the handling and guiding string and about to be landed on the drilling guide structure, the unit carrying a wellhead; and FIG. 12 is a diagrammatic elevational view with parts in section showing two wellheads, landed on two well casings and coupled to the drilling guide structure via two flowline assemblies, and a production gathering assembly about to be landed on the drilling guide structure and coupled to the flowline assemblies.

DETAILED DESCRIPTION OF THE INVENTION

Figure 1:
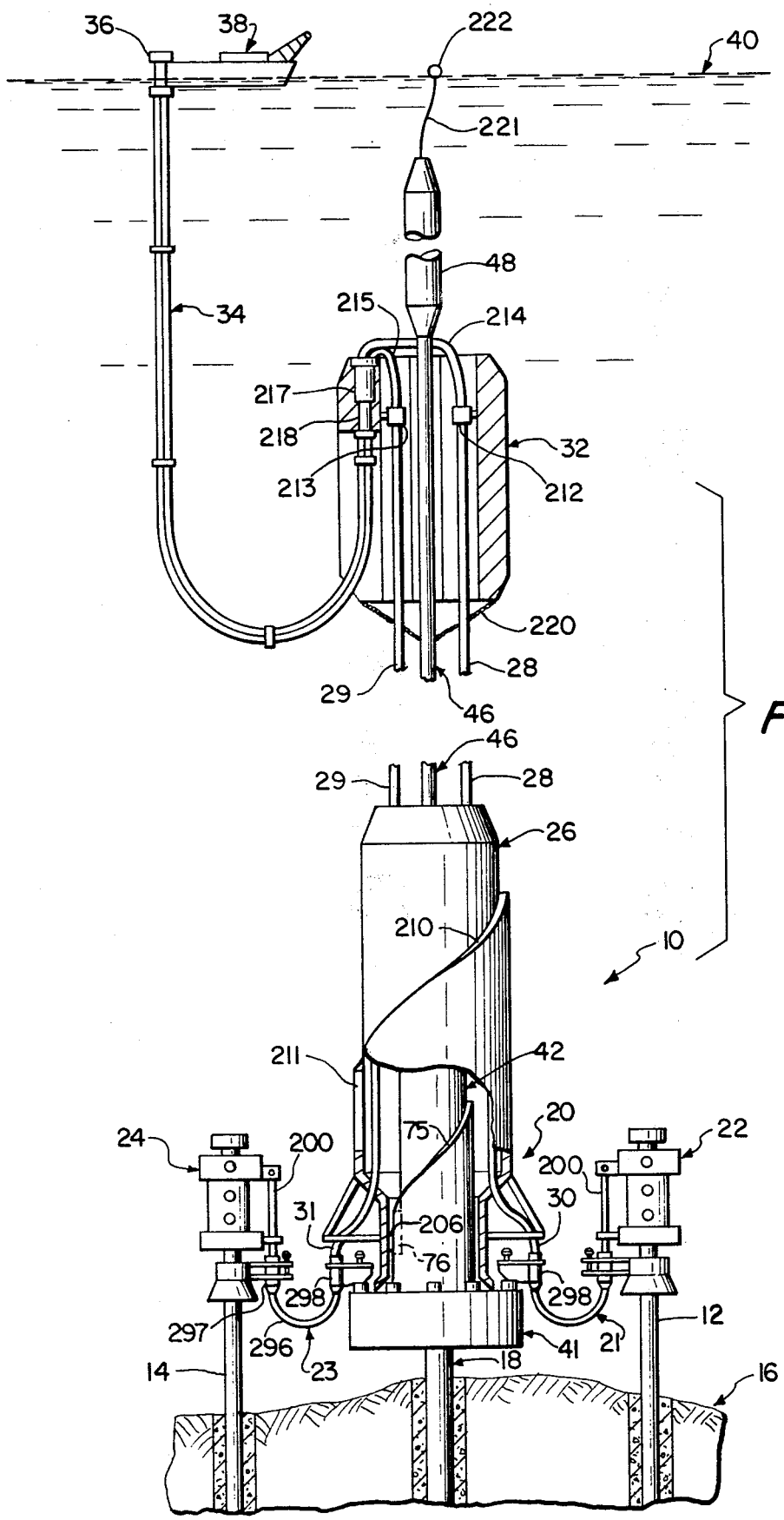
FIG. 1 is a diagrammatic elevational view with parts in section of a remotely established underwater well in accordance with the invention.

As seen in FIG. 1, the established well assembly 10 in accordance with the invention is shown including two well casings 12 and 14 extending into the floor 16 of a body of water. Only two are shown by way of example, this well assembly 10 being capable of producing oil or gas through additional well casings of various radii from the central portion thereof. The well casings extend out of the floor adjacent to a drilling guide structure 20, which is supported on an upright support 18 which is also implanted in the floor. A pair of wellheads 22 and 24 are supported on the well casings, and the guide structure has a production gathering assembly 26 supported thereon which is in fluid-flow communication with the wellheads via cross-over flowline assemblies 21 and 23. This gathering assembly has a pair of flowline risers 28 and 29 extending upwardly therefrom and a pair of flowline stab-in connectors 30 and 31 extending downwardly therefrom into communication with the two flowline assemblies. The upwardly extending flowline risers are coupled to a submerged buoy 32 near, but below, the surface 40 of the body of water and are in fluid flow communications with a catenary flowline bundle 34 extending from the buoy 32 to a single-point mooring buoy 36 at the surface. This buoy is rotatably connected to a production vessel 38 which ultimately receives the oil or gas from the well casings. Extending upwardly as part of the drilling guide structure 20 is a tubular member 42 which, via connector 44, is connected to an upwardly extending handling and guiding string 46 which terminates in an elongated tensioning buoy 48 near, but below, the surface 40.

The Upright Support and The Drilling Guide Structure

Figure 2:
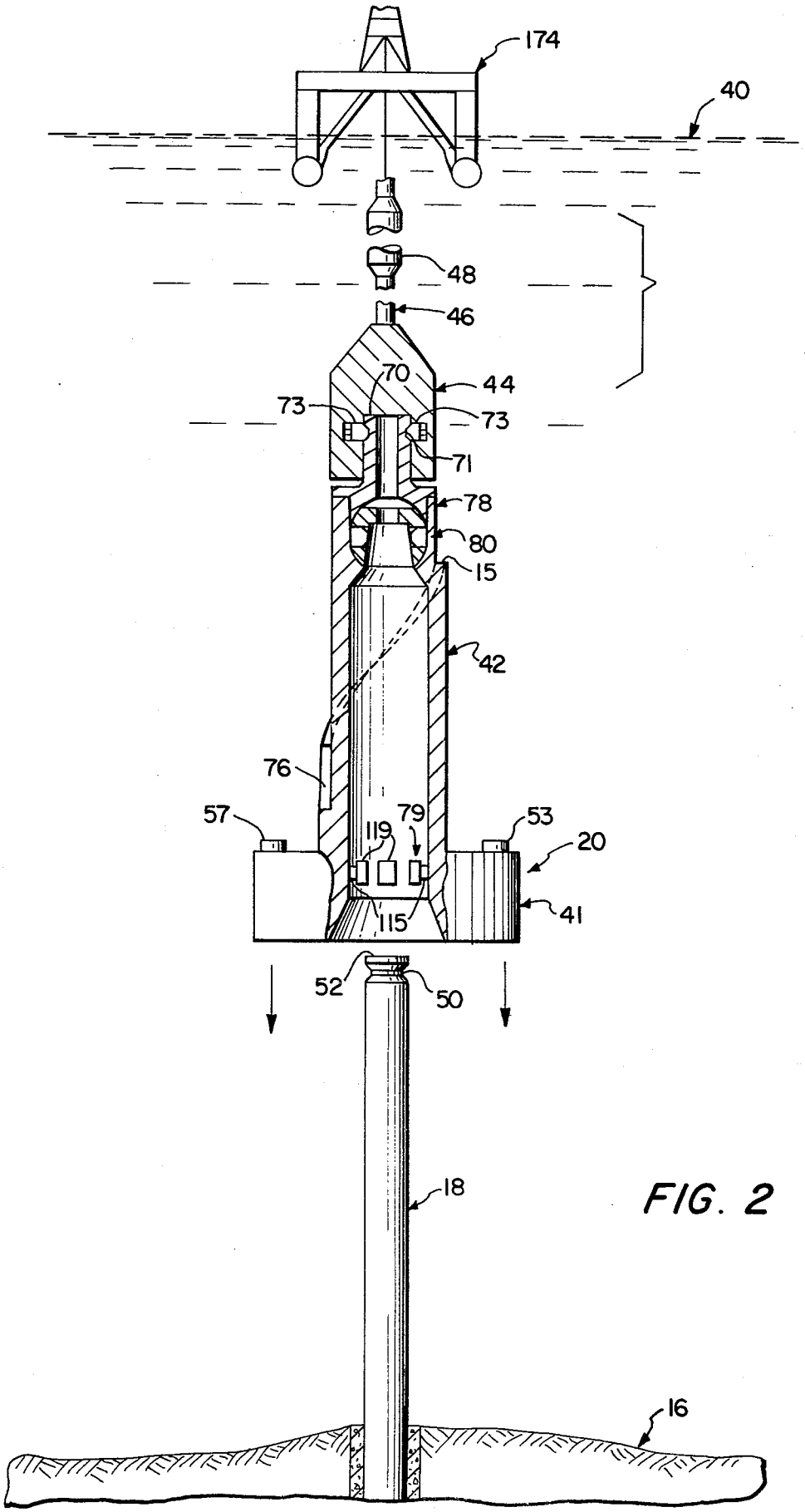
FIG. 2 is a diagrammatic elevational view with parts in section showing the drilling guide structure being lowered by the handling and guiding string from an operational base at the water surface onto an upright support implanted in the floor of the body of water.

As seen in FIG. 2, the upright support 18, which can be a cylindrical pile or a casing from an established well, has a cylindrical outer surface, an annular groove 50 near the top and an upwardly facing annular shoulder 52 at the top. This upright support is implanted in the floor 16 and cemented thereto, preferably but not necessarily in a vertical position. Since it is advantageous to have the horizontal part of the drilling guide structure 20 level with the surface 40 and thus tubular member 42 vertical, the drilling guide structure incorporates a levelling assembly as will be discussed in detail hereinafter.

Figure 3:
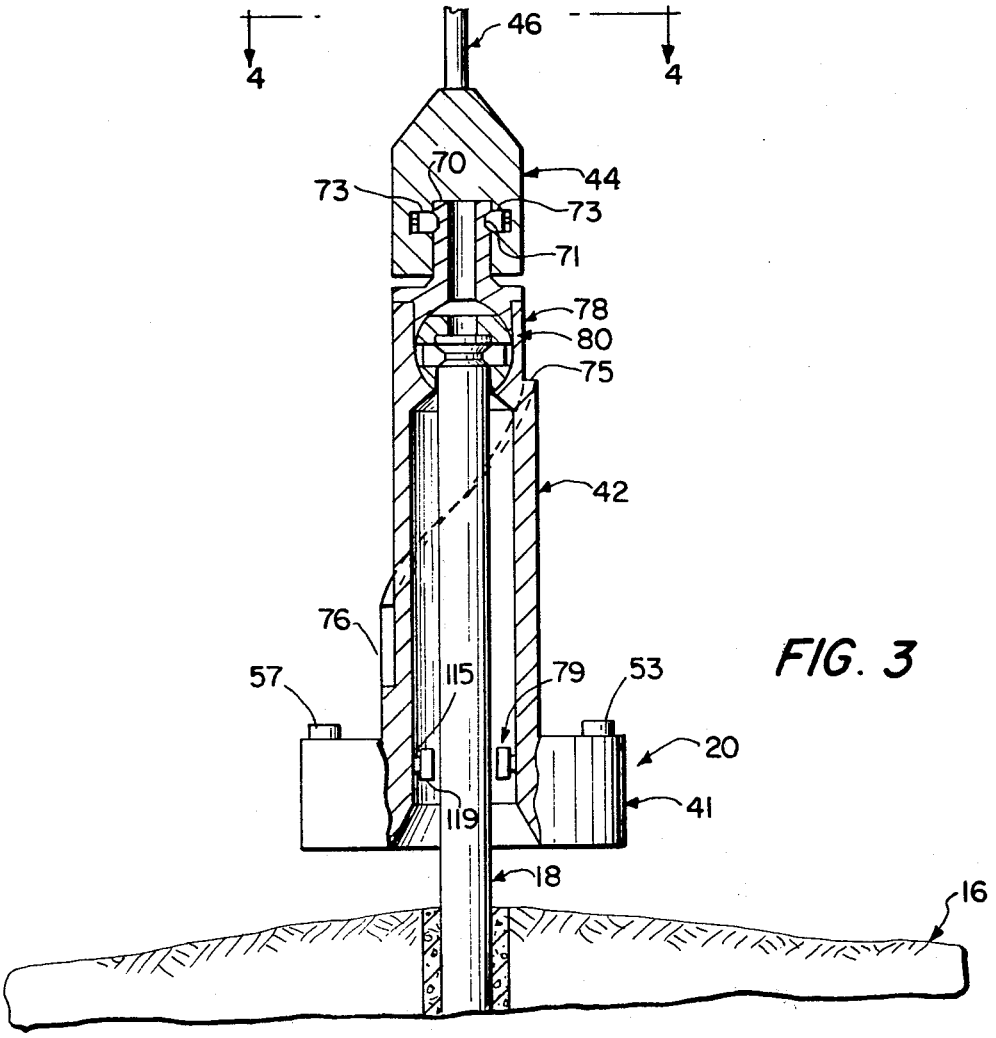
FIG. 3 is a diagrammatic elevational view with parts in section similar to that shown in FIG. 2 except that the drilling guide structure had landed on the upright support and has gravitated to a vertical position and is locked to the upright support to prevent relative axial movement therebetween.
Figure 4:
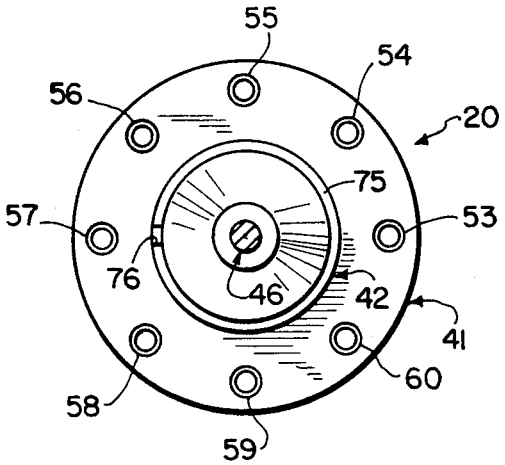
FIG. 4 is a diagrammatic top plan view in section taken along lines 4—4 in FIG. 3 showing the drilling guide structure.

As seen in FIG. 2–7, the drilling guide structure 20 is in the form of a substantially planar member 41 formed, for example, from a plurality of tubes rigidly coupled together, and includes eight equally radially and circumferentially spaced stab-in connectors 53–60, as seen in FIG. 4, and the tubular member 42 perpendicular to member 41. There could be more or less of these stab-in connectors, with eight being used to illustrate the invention.

Figure 5:
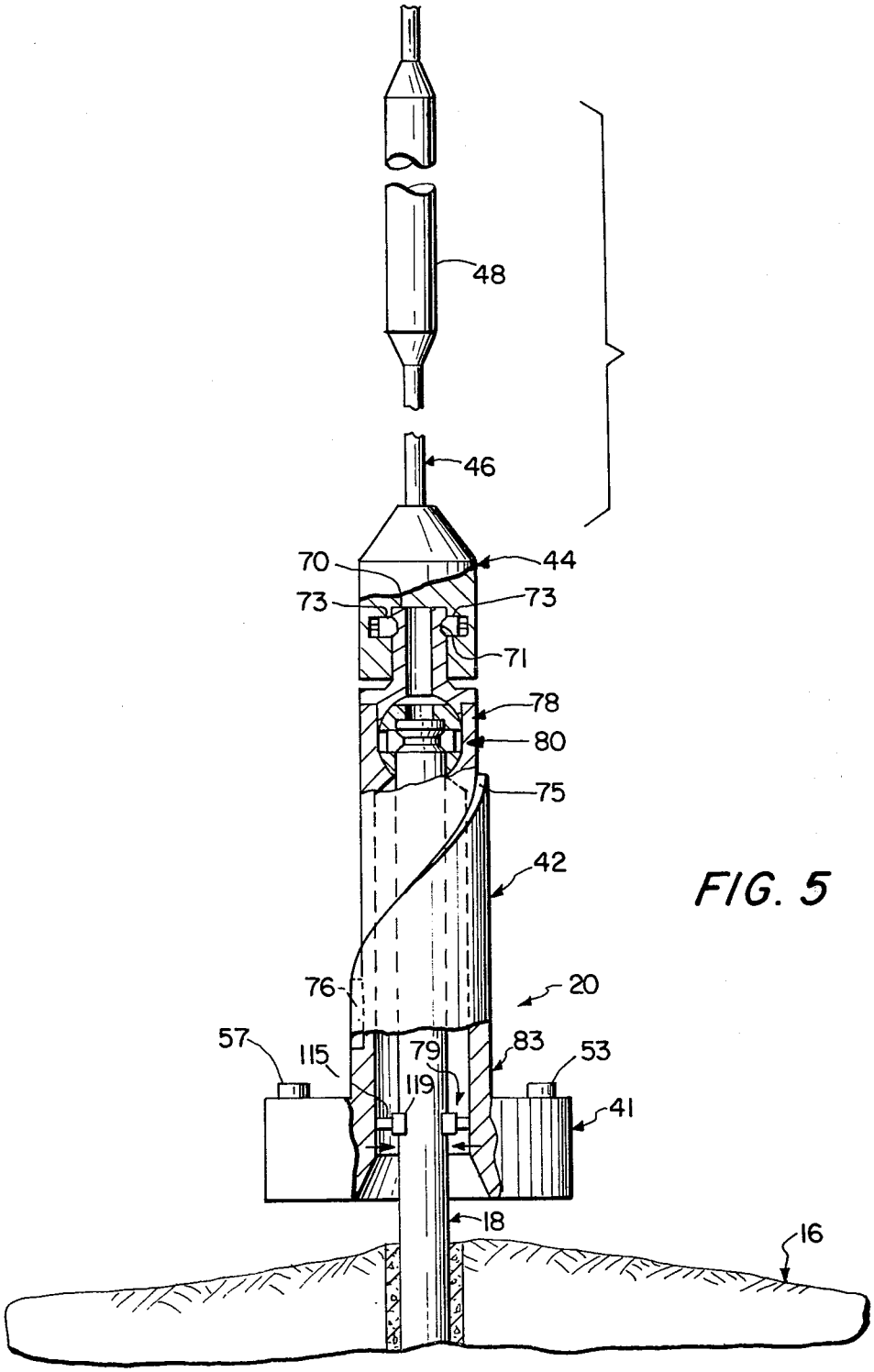
FIG. 5 is a diagrammatic elevational view similar to that shown in FIG. 3 except that the drilling guide structure has been secured to the upright support in the vertical position.

As seen in FIG. 2–6, the tubular member 42 is centrally located relative to the drilling guide structure 20 and extends perpendicularly upwardly from member 41, having a male hub 70 at the top, this hub having an annular locking groove 71 with a substantially trapezoidal cross section. This male hub and groove combination form a connector member to connect the tubular member to the female connector 44 carried by an end of the handling and guiding string 46. As seen in FIGS. 2, 3 and 5, the connector 44 has a plurality of radially movable locking dogs 73 which can, under conventional hydraulic control, move into a locking position with locking groove 71 on the male hub.

As seen in FIGS. 2–6, the tubular member 42 has on its outer surface a rotational orientation reference member 75 in the form of an annular but sloping camming surface which extends completely around the outside of the tubular member, is higher on the right hand side as seen in FIGS. 2–6 than on the left hand side, and is interrupted on the left hand side by a vertical downwardly extending locator slot 76.

To level the drilling guide structure 20 member 41 relative to the water surface 40 on the upright support 18 the structure, and in particular the tubular member 42, has a pivot device 78 to allow the guide structure to pivot gravitationally into a level position relative to the upright support, a securing assembly 79 to secure the guide structure to the upright support in the level position and a locking assembly 80 to lock the guide structure to the upright support to prevent relative axial movement. The pivot device 78 and locking assembly 80 are shown in detail in FIG. 6 while the securing assembly 79 is shown in detail in FIG. 7.

Figure 6:
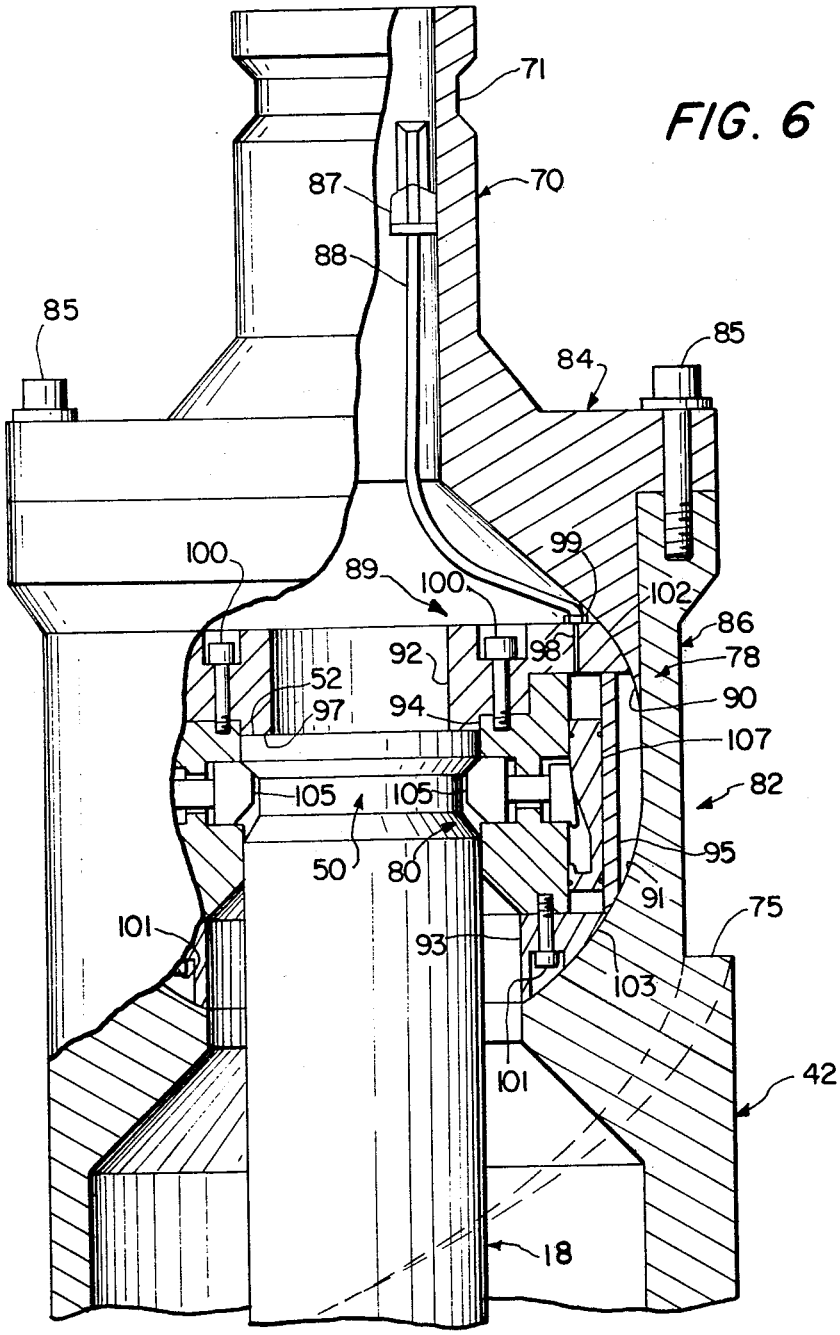
FIG. 6 is an enlarged elevational view with parts in section showing in detail a locking assembly for locking the drilling guide structure to the upright support against relative axial movement and a pivot device between the drilling guide structure and the upright support to allow the drilling guide structure to gravitate to a vertical position.

Referring now to FIGS. 5 and 6, the tubular member 42 has an upper end portion 82, a lower end 83 and a longitudinal axis. The tubular member is hollow and has transverse dimensions such that this member and the guide structure can surround and be spaced outwardly from the upright support 18 at the lower end of the tubular member and for at least a substantial portion of the length of the member commencing at the lower end 83 thereof. This tubular member 42 is basically comprised of an upper annular member 84 coupled via bolts 85 to a lower annular member 86 having a substantially cylindrical outer surface along its length until it is interrupted by orientation member 75. The upper annular member 84 has the hollow male hub 70 extending upwardly therefrom and on the inside of this hub is a conventional female hydraulic stab-in connector 87 having a hydraulic line 88 extending downwardly therefrom. The pivot device 78 is formed from an annular assembly generally indicated at 89 having an outer surface which is a portion of a sphere, and a socket assembly formed by an upper surface 90 in the form of a part of a sphere on the bottom of upper annular member 84 and a lower surface 91 in the form of a part of a sphere formed integrally and extending inwardly of the lower annular member 86 in the tubular member 42.

As seen in FIG. 6, the annular assembly 89 is formed from an upper ring 92, a lower ring 93, a central ring 94 between rings 92 and 93 and an outer ring 95. Upper ring 92 has a downwardly facing central annular shoulder 97 which engages upwardly facing shoulder 52 on the top of the upright support 18. This upper ring 92 also has a vertical bore 98 passing completely therethrough, which bore is connected via a fitting 99 to hydraulic line 88. The upper ring 92 is connected to the central ring 94 by a plurality of bolts 100 and the lower ring 93 is connected to the central ring by a plurality of bolts 101. The outer surfaces 102 of upper ring 92 and 103 of lower ring 93 are formed as portions of a sphere and slidably engage surfaces 90 and 91, which are also in the shape of a spherial socket, to provide a pivotal support to the tubular member 42 on the upright support 18 with freedom of pivotal movement about all axes transverse to the upright support.

The locking assembly 80 is basically comprised of a plurality of locking dogs 105 that are horizontally supported in suitable bores in the central ring 94 for movement radially inwardly into a locking engagement with the locking groove 50 on the upright support 18. These locking dogs are moved radially inwardly by means of downward movement of an annular piston 107 received between the outer surface of central ring 94 and the inner surface of outer ring 95. Bore 98 in the upper ring 92 delivers hydraulic fluid to piston 107 from line 88 and connector 87 when the handling and guiding string 46 is connected to hub 70, the string 46 having a conventional male hydraulic stab-in connector for connection with female stab-in connector 87. Downward movement of piston 107 biases the locking dogs 105 radially inwardly due to the upwardly and inwardly tapered frustoconical surface on the inside of the piston and a corresponding surface in the form of a cam follower on the outside of the locking dogs. To release the locking dogs, a suitable hydraulic connection can be made to provide hydraulic pressure to the bottom of piston 107 which is then driven upwardly and has an upwardly and inwardly tapering outwardly facing frustoconical surface which engages a similarly inwardly facing surface on the locking dog. Such a piston and locking dog combination is conventional and is disclosed in U.S. Pat. No. 3,228,715 to Neilon et al, the disclosure of which is hereby incorporated by reference.

Figure 7:
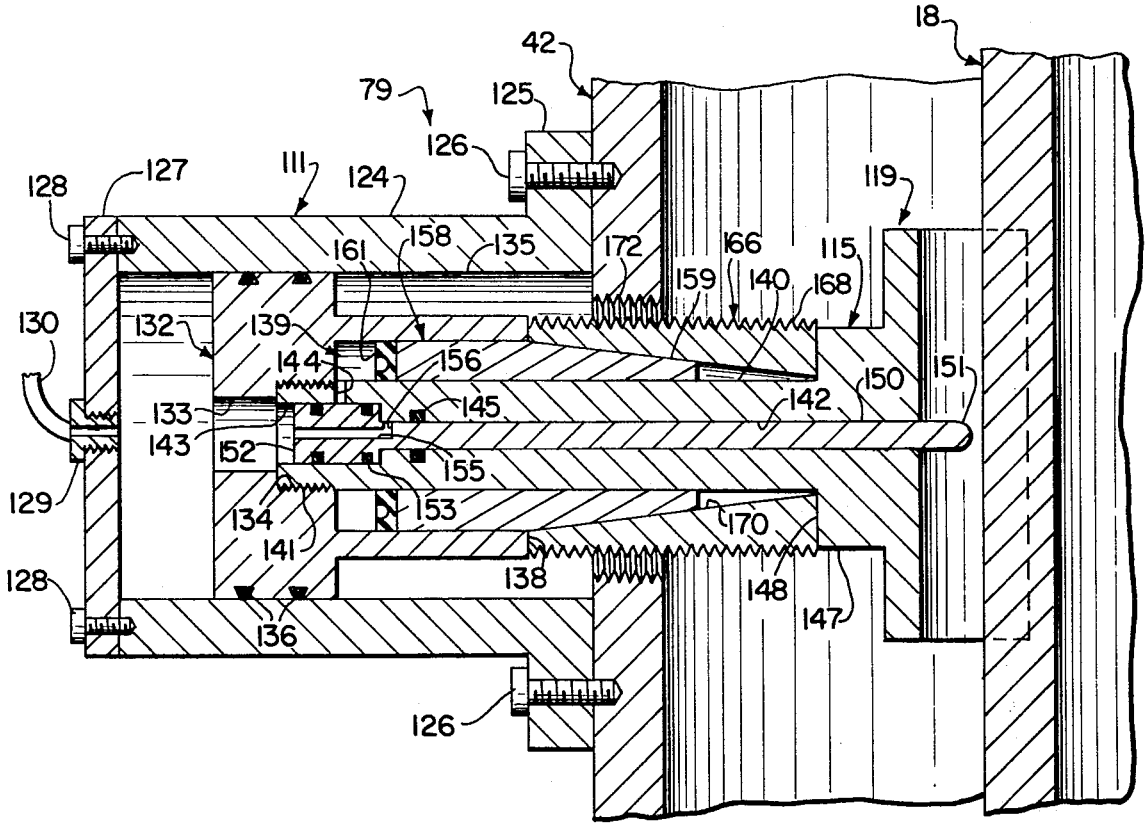
FIG. 7 is an enlarged elevational view in vertical section of one of the securing assemblies that secure the drilling guide structure to the upright support in the vertical position.

The securing assembly 79 for securing the tubular member 42 and guide structure 20 in their vertical position to the upright support 18 is shown generally in FIGS. 2, 3 and 5 and in detail in FIG. 7. Basically, this securing assembly 79 comprises four hydraulic cylinders 111 rigidly coupled to tubular member 42 near the lower end 83 with a plurality of associated piston rods 115 extending therefrom, extending through apertures in the tubular member 42 and having curved gripping members 119 rigidly coupled thereto, these gripping members ultimately engaging the upright support 18.

Referring now to FIG. 7, the structure of hydraulic cylinder 111, piston rod 115 and gripping member 119 is illustrated in detail, the remaining cylinders, piston rods and gripping members being similarly constructed. Hydraulic cylinder 111 is comprised of an open ended cylinder 124 having an outwardly extending radial flange 125 bolted via bolts 126 to tubular member 42 and a disc-shaped cap 127 closing the outer end of cylinder 124 and being coupled thereto by a plurality of bolts 128. This cap 127 has a threaded central aperture for threadedly receiving a hydraulic fitting 129 having a hydraulic line 130 coupled thereto. Preferably, each of the hydraulic lines extending from the plurality of cylinders 111 are connected in a bundle.

Slidably received along the inner cylindrical surface of cylinder 124 is a disc-shaped piston 132 having a central bore 133 extending into the piston from the left hand side, a threaded larger diameter counter bore 134 extending into the piston coaxially with bore 133 from the right hand side and a cylindrical flange 135 extending axially from the right hand side of the piston. On the exterior cylindrical surface of piston 132 are suitable annular grooves receiving O-ring seals 136 therein. Cylindrical flange 135 has a diameter greater than threaded bore 134 and had an annular end shoulder 138 facing upright support 18.

Piston rod 115 comprises a cylindrical tube 140 having a threaded end 141 threadedly engaging threaded bore 134 in the piston. Tube 140 has a central cylindrical bore 142 extending completely therethrough with a counter bore 143 of a larger diameter than the diameter of bore 142 being formed in the threaded end 141. A radially extending bore 144 passes through the wall of tube 140 from the counter bore 143 into the annular space 139 defined inside cylindrical flange 135 on the piston. Adjacent the end of counter bore 143 is a radially outwardly directed groove formed inside tube 140 along bore 142 to receive an O-ring seal 145. At the other end of tube 140 is an enlarged cylindrical boss 147 which has an annular shoulder 148 extending towards cylindrical flange 135 and which has the curved gripping member 119 at the end facing support 18.

Slidably received inside counter bore 143 and central bore 142 of the piston rod 115 is an actuating rod 150 having a tip 151 at the end adjacent to upright support 18 and an enlarged cylindrical body 152 at the other end, this body being slidably received in counter bore 143. This body has suitable annular grooves for receiving O-ring seals 153 therein in slidable sealing engagement with counter bore 143. A central bore 155 extends into the cylindrical body 152 and is intercepted by a radially directed bore 156 which extends to the outer cylindrical surface of rod 150.

Slidably received on the outside of tube 140 and along the inside of cylindrical flange 135 is a generally cylindrical tube 158 having an upwardly and inwardly tapering frustoconical portion 159 on the outer surface adjacent cylindrical boss 147. An annular pressure-activated rubber gasket 161 is interposed between cylindrical flange 135 and tube 140 with an edge abutting the outer end of tube 158. This gasket has an annular recess on the face away from tube 158 so that it is pressure activated to seal between flange 135, tube 158 and tube 140 when hydraulic fluid enters annular recess 139 defined by the gasket, piston, cylindrical flange 135 and tube 140.

A split ring 166 is received between annular end shoulder 138 of the cylindrical flange 135 and annular end shoulder 148 of the cylindrical boss, this split ring having a substantially cylindrical outer surface with serrations 168 thereon. The inner surface 170 of the split ring is an upwardly and inwardly tapering frustoconical surface which is in slidable engagement with frustoconical portion 159 on tube 158. As is evident, when tube 158 is moved towards the upright support, the engaging frustoconical portion 159 and surface 170 will bias the split ring 166 radially outwardly.

The split ring 166 is received in a substantially circular aperture 172 in tubular member 42, the surface of this aperture being serrated so that once the serrated outer surface of the split ring engages these serrations on the aperture, there will be no relative movement longitudinally therebetween.

The Handling and Guiding String

Referring again to FIG. 2, the handling and guiding string 46 is shown extending between an operational base 174, such as a drilling rig, at the surface 40 and the guide structure 20 to which the string is coupled via the connection of connector 44 to tubular member 42. The elongated tensioning buoy 48 is located near but below the surface 40 at about 200 feet once the drilling guide structure is fully received on the upright support 18 as shown in FIG. 3. The string is formed from a plurality of interconnected casing members and is lowered by means of a conventional lowering winch.

The Drilling Guide Arm Unit

Figure 8:
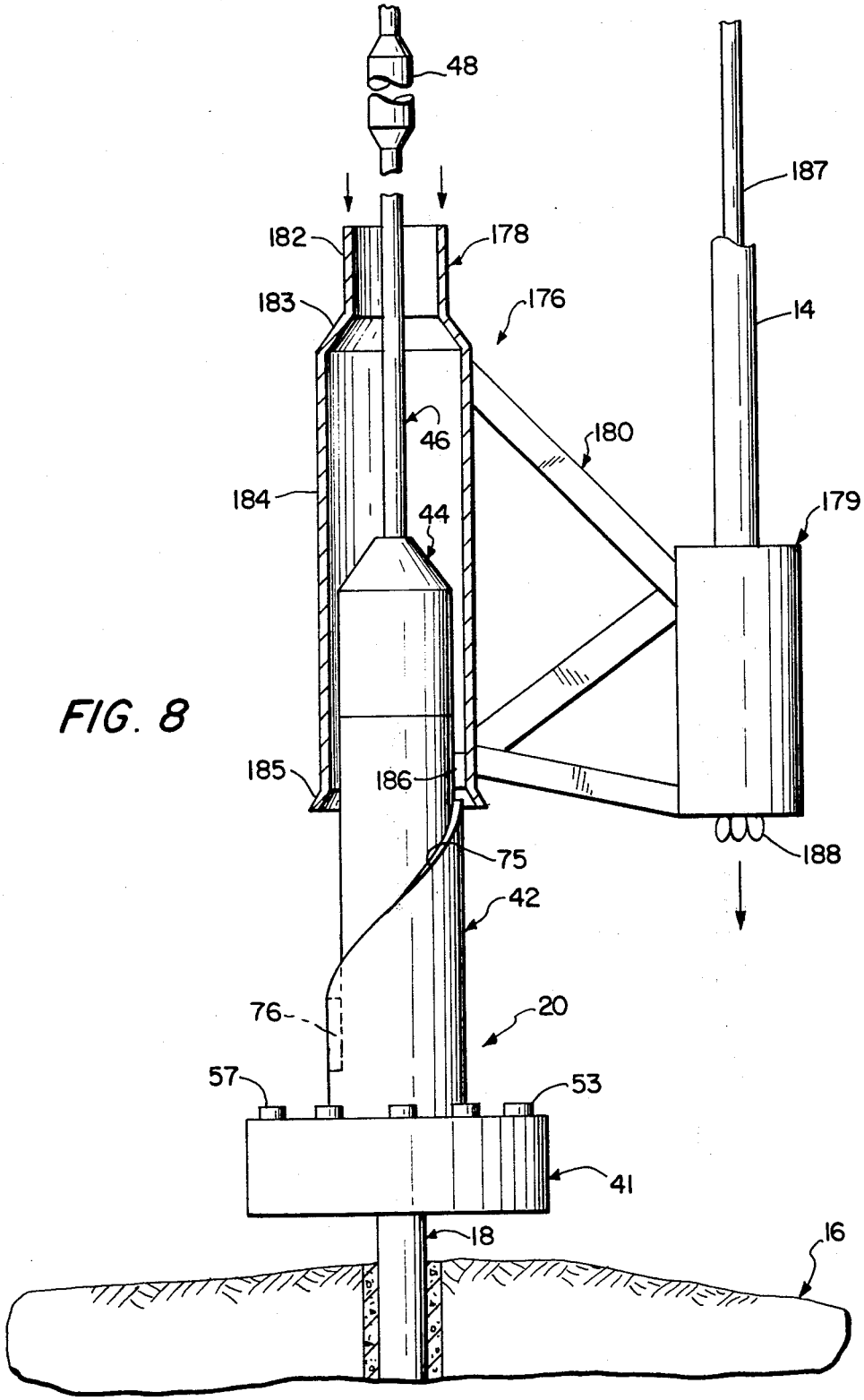
FIG. 8 is a diagrammatic elevational view with parts in section of the structure shown in FIG. 5 with the addition of a drilling guide arm unit being lowered on the handling and guiding string, this unit carrying a drilling string, drilling bit and well casing.
Figure 9:
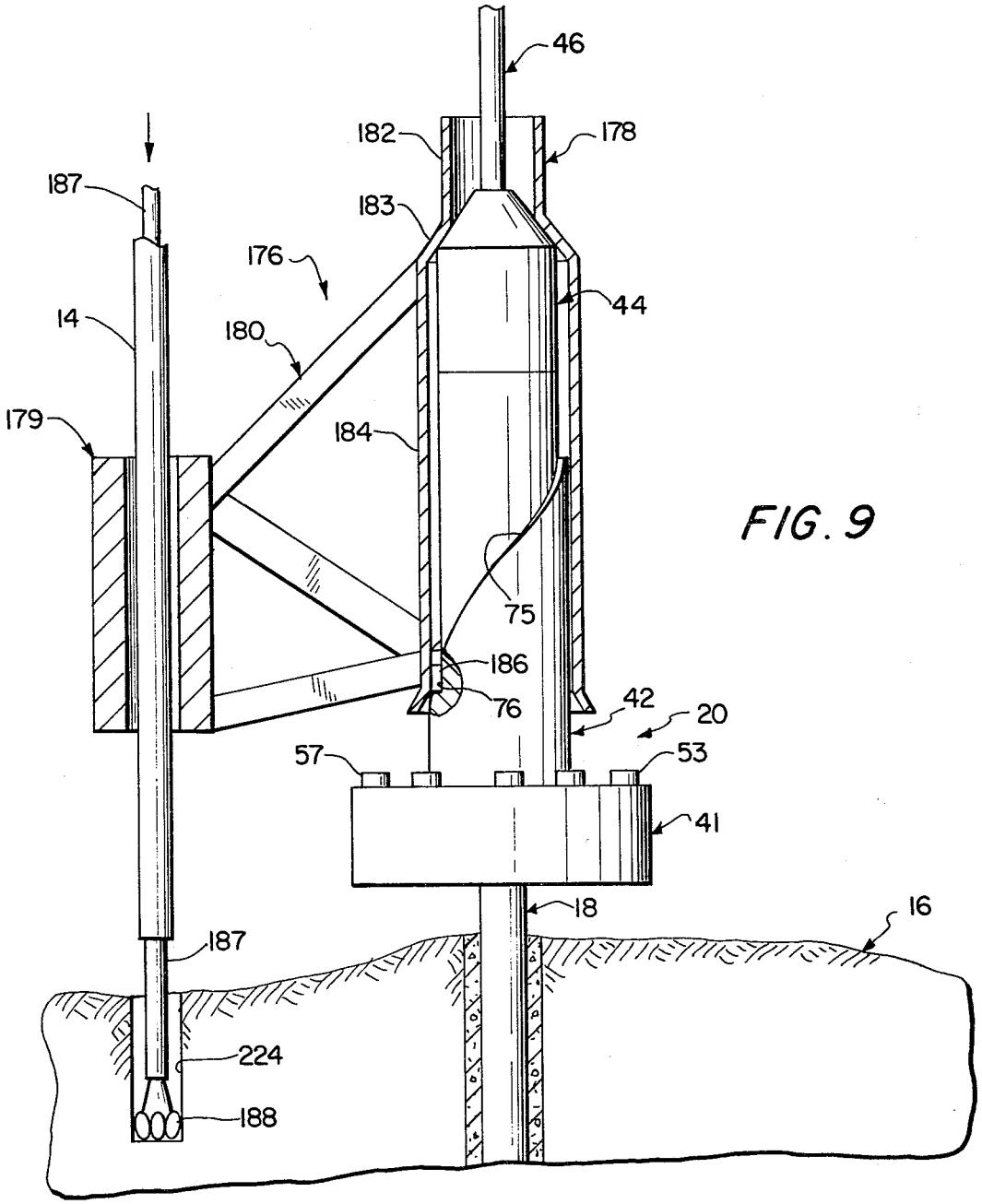
FIG. 9 is a diagrammatic elevational view with parts in section similar to that shown in FIG. 8 except that the drilling guide arm unit has rotated and moved axially downwardly relative to the drilling guide structure so that the drilling bit is oriented over a position where a well is desired.

As seen in FIGS. 8 and 9, a drilling guide arm unit 176 is formed from an open-ended member 178, which is hollow and tubular, a guiding member 179, and a support structure 180 rigidly supporting the guiding member 179 from the open-ended member 178. The open-ended 178 comprises a cylindrical portion 182, an upwardly and inwardly tapering frustoconical portion 183, a cylindrical portion 184, and an upwardly and inwardly tapering outwardly extending frustoconical flange 185. A locator key 186 extends radially inwardly from the inner surface of cylindrical portion 184 and acts as a rotational orientation reference member for engagement with orientation member 75 and slot 76 on the outer surface of tubular member 42. The key 186 has a rectangular cross section as does slot 76 and key 186 can be received and move longitudinally of slot 76 until the key bottoms out on the upwardly facing bottom of the slot 76. As seen in FIG. 8, the key is located just above the flange 185 on the open ended member 178 and is in substantially the same plane as support structure 180. Due to this orientation, the key will slide down orientation member 75 and then into slot 76 while bringing the guiding member 179 into an alignment with a desired drilling location as shown in FIG. 9. To vary the alignment of this guiding member 179 relative to other desired drilling locations, the circumferential location of the key relative to the open ended member 178 can be varied. Similarly, changing the radial extent of the support structure 180 will vary the radial position of the guiding member 179 so that it could be aligned with a drilling location at any desired radial distance from the central tubular member 42. The guiding member 179 carries with it well casing 14, which can also be referred to as a surface conductor, a drilling string 187 and a drilling bit 188 at the end of the drilling string. In the position shown in FIG. 8, the combined drilling string, drilling bit and casing is supported by the guiding member by means of a releasable connector such as a suitable hydraulic connector or a series of shear pins. The drilling string 187 is lowered with the well casing and the drilling guide arm unit 176 from the surface by a lowering winch supported on the operational base 174. As seen in FIG. 8, the transverse dimension of the elongated tensioning buoy 48 is smaller than the inner diameter of the open-ended member 178 so that this member can slidably move downwardly and past the elongated buoy as the member slides down the handling and guiding string 46.

The Flowline Guide Arm Unit and Flowline Assembly

As seen in FIG. 10, the flowline guide arm unit 290 is similar to the drilling guide arm unit 176 and thus includes an open-ended member 291, a guiding member 292 and a support structure 293. Located on the inner surface of the open-ended member 291 is a locator key 294 similar to key 186 described above. Support structure 293 is connected to a lowering line 295 which is in turn connected to a lowering winch on the operational base 174 to lower the guide arm unit 290 in a controlled fashion along the handling and guiding string 46.

The cross-over flowline assembly to be lowered by the guide arm unit is intended to conduct fluid between the wellheads and the production gathering assembly 26 as shown in FIG. 1. Each flowline assembly comprises a flowline 296 with a pair of upwardly-facing female stab-in connectors 297 and 298 at opposite ends, a casing support 299 coupled to stab-in connector 297, an upwardly facing male connector member 300 coupled to stab-in connector 297, and a second upwardly-facing male connector member 301 coupled to the other stab-in connector 298 and having a downwardly-facing male stab-in connector 302 thereon. The upwardly-facing male connector members 300 and 301 are reasonably coupled to downwardly-facing female connectors 303 and 304 carried by guiding member 292.

By changing the radial distance between female connectors 303 and 304 on member 292, the casing support 299 can be coupled to well casings in any desired radial distance from the drilling guide structure 20. A change in the circumferential position of the locator key 294 on open-ended member 291 can vary the alignment of the guiding member 292 and thus the flowline assembly coupled thereto so that the flowline assembly can be coupled to well casings of any desired circumferential position.

In addition to interconnecting the wellheads with the production gathering assembly via the flowline assemblies, the flowline guide arm unit 290 can be used to land control line assemblies between the wellheads and the production gathering assembly to actuate various valves on the wellheads. These control line assemblies would have a configuration similar to the flow-line assemblies with similar stab-in connections.

The Wellhead Guide Arm Unit

As seen in FIG. 11, the wellhead guide arm unit 190 is similar to the drilling guide arm unit 176 and thus includes an open-ended member 191, a guiding member 192 and a support structure 193 interconnecting members 191 and 192. Located on the inner surface of the open-ended member is a locator key 194 similar to key 186 described above. As seen in FIG. 11, the guiding member 192 is connected to a lowering line 195 which is in turn connected to a lowering winch on the operational base 174 to lower the wellhead guide arm unit 190 in a controlled fashion along the handling and guiding string 46. As with the drilling guide arm unit 176, a change in the radial extent of the support structure 193 and the circumferential position of the locator key, which forms an orientation member, can vary the alignment of the guiding member 192 and thus the wellhead 24 coupled thereto relative to the well casing located in the floor 16. Similarly, the guiding member 192 has a suitable hydraulic connector or series of shear pins to releasably couple the wellhead 24 thereto.

This wellhead 24 has at the bottom a female stab-in connector 197 to releasably connect the wellhead to the casing 14 via an upwardly facing male connector 198 at the top of the casing. Extending downwardly from the wellhead 24 is a flowline 200 having a male stab-in connector 201 at the bottom thereof and downwardly facing. This male stab-in connector 201 is intended to make a connection with upwardly facing female stab-in connector 297 on the flowline assembly 23 as shown in FIG. 12.

The Production Gathering Assembly

As seen in FIG. 12, the production gathering assembly 26 is comprised of an open-ended member 205 which is hollow and tubular and which has the flowline risers 28 and 29 extending upwardly therefrom and the rigid flowline stab-in connectors 30 and 31 extending downwardly therefrom. Additional risers and connectors can be utilized when more than two wellheads are used. In addition to the flowline connectors and risers, suitable control line risers and connectors can be carried by the production gathering assembly to deliver control fuid to the wellheads. The smallest inner diameter of the open-ended member 205 is larger than the transverse dimension of the elongated tensioning buoy 48 on the handling and guiding string 46 so that the production gathering assembly can be lowered over the buoy and down the string. On the inner surface of the open-ended member is a locator key 206 in the form of an orientation member similar to keys 186 and 194 described above regarding the drilling and wellhead guide arm units. The male stab-in connectors 30 and 31 are intended to be received in the female stab-in connectors 298 in the flowline assemblies 21 and 23. Changing the location of the locator key 206 circumferentially of the open-ended member will vary the orientation of the flowline stab-in connectors relative to the female stab-in connectors. As seen in FIG. 12, on the outside of the open-ended member 205 is a second orientation member 210 in the form of a sloping annular surface having a slot 211 at the bottom. This member 210 has a similar orientation as orientation member 75 on the tubular member 42 once the production gathering assembly is fully landed on the tubular member, as shown in FIG. 1, so that additional tools or devices can be lowered down the handling and guiding string 46 onto the production gathering assembly and suitably orientated relative to any position or apparatus on the drilling guide structure 20 or relative to any wellhead.

The Annular Submerged Buoy And The Production Vessel

Referring again to FIG. 1, the flowline risers 28 and 29 are shown extending upwardly from the production gathering assembly 26 where they are rigidly connected via connectors 212 and 213 to the submerged annular buoy 32. Suitable cross-over tubes 214 and 215 extend in fluid flow communication from these flowline risers to a female connector member 217 carried by buoy 32 which is in turn in fluid flow communication with an upwardly facing male connector member 218 on the end of the catenary flowline bundle 34. This connection between the male and female connector members 217 and 218 can be accomplished in any desired fashion, preferably by pulling the male connector member upwardly into the female connector member by means of a wireline connected to the end of the male connector member, running up through the female connector member and then to the surface where it is connected to, for example, a winch. In all events, this construction allows fluid flow communication between the risers and the production vessel 38 by means of the cross-over tubes 214 and 215, the female connector member 217, the male connector member 218, the catenary flowline bundle 34 and the single-point mooring buoy 36.

As seen in FIG. 1, advantageously the handling and guiding string 46 can be flexibly connected to the submerged buoy 32 by means of chains 220.

The elongated tensioning buoy 48 can be disconnected from the handling and guiding string above it and then can be connected to a line 221 extending upwardly to a marker buoy 222 at the surface 40 of the body of water.

Operation

In order to remotely establish the underwater well assembly 10 shown in FIG. 1 under conditions of great water depth, such as below 1000 feet, the first step is to install at the floor 16 of the body of water the generally upright support 18 and rigidly secure this support so that it projects upwardly from the floor as seen in FIG. 2.

Then, the drilling guide structure 20 with the tubular member 42 extending upwardly therefrom is lowered onto the upright support by means of the handling and guiding string 46 coupled to the tubular member.

Once the drilling guide structure is landed on the upright support, as shown in FIG. 3, the drilling guide structure is allowed to level itself gravitationally. This is accomplished, as seen in FIG. 6, by having the upwardly facing annular shoulder 52 on the top of the upright support engage the downwardly facing annular shoulder 97 in the pivot device 78, activating the locking dogs 105 in locking assembly 80 to couple the drilling guide structure to the upright support and allowing the drilling guide structure to pivot relative to the upright support via the pivot device 78. This levelled position is shown in FIG. 3 wherein member 41 is level relative to the water surface and member 42 is vertical relative to the surface.

Next, the drilling guide structure is locked to the upright support in the levelled position as seen in FIG. 5. This is accomplished by activating the securing assembly 79 so that gripping members 119 extend radially inwardly from the tubular member 42 into contact and engagement with the upright support 18. Since each of the four gripping members 119 will probably be a different radial distance from the outer surface of the upright support, because the upright support is not necessarily vertical, these gripping members will stop their radially inwardly directed movement when they respectively contact and engage the outer surface of the upright support.

This is accomplished by action of the structure shown in FIG. 7 by means of the actuating rods 151 associated with each piston rod which stop radially inward movement of each gripping member when each engages the exterior surface of the upright support. This occurs because, when the actuating rod tip 151 engages the outer surface of the upright support, the split ring 166 is moved radially outwardly to engage the serrated interior of aperture 172. With this ring locked to the aperture, piston rod 115 cannot move further radially inwardly towards the upright support because frustoconical portion 159 engages frustoconical surface 170 on the inside of the split ring 166 and annular shoulder 138 on flange 135 abuts ring 166, this flange being coupled to the piston 132 which is in turn coupled to the piston rod 115.

To initially move the piston rod 115 and gripping member 119 towards the upright support, hydraulic fluid via hydraulic line 130 enters cylinder 111 to push piston 132, which is coupled to rod 115 and gripping member 119, in the radially inward direction. This continues until the tip 151 of rod 150 engages the outer surface of the upright support which displaces rod 150 radially outwardly so that the radial bore 156 therein is in fluid flow connection via counter bore 143 with radial bore 144 in tube 140. Thus, hydraulic fluid can now flow from cylinder 111 through bore 133 in the piston, then into rod 150 and through axial bore 155, through radial bore 156, through counter bore 143 into radial bore 144 and then into the annular recess 139 between cylindrical flange 135 and tube 140. The hydraulic fluid and pressure thus present in recess 139 pushes tube 158 radially inward of the upright support so that the outer frustoconical portion 159 thereon slidably engages the inner frustoconical surface 170 on the split ring, thereby driving the split ring outwardly into locking engagement with the aperture 173. This stops the movement of piston rod 115 towards the upright support.

Following this step, the drilling guide arm unit 176 is lowered, as seen in FIG. 8, along the handling and guiding string 46 onto the tubular member 42 on the drilling guide structure 20. The drilling guide arm unit carries the drilling string 187, the drilling bit 188 and the well casing 14. As the drilling guide arm unit is landed on the tubular member, locator key 186 engages orientation member 75, thus rotating the drilling guide arm unit and the drilling bit relative to the tubular member and moving it downwardly thereof, as seen in FIG. 9. This orients the drilling bit with the desired drilling location by means of such coaction between the drilling guide arm unit and the tubular member on the drilling guide structure.

Next, as seen in FIG. 9, the drilling bit and drilling string are used to drill a well 224 into the floor 16. At the same time the well casing 14 is moved downwardly into the well 224, as shown in FIG. 10. During this drilling operation, conventional drilling practices and apparatus are utilized including an upper body, a blow out preventor, a drilling upper body, a lower wellhead body, a drilling wellhead and any another necessary or desired equipment, which is lowered to the drilling guide structure 20 and oriented in a fashion similar to that shown in FIGS. 8 and 9.

As is evident, once the entire well casing is installed in the well and drilling is completed, the drilling string, drilling bit and drilling guide arm unit, as well as any other drilling equipment, are retrieved to the surface.

The steps illustrated in FIGS. 8 and 9 with regard to lowering and orienting the drilling guide arm unit and then drilling the well are repeated for any desired additional drilling locations.

Once these steps are accomplished, the flowline assemblies 21 and 23 are lowered into place on the well casings and the production gathering assembly as shown in FIGS. 10 and 11. This is effected by lowering, for example, flowline assembly 23, via flowline guide arm unit 290, towards the floor 16 along the handling and guiding string 46. When the flowline guide arm unit is landed on the tubular member 42, the unit is oriented with the well casing 14 and the upwardly-facing female stab-in connector 57 on the drilling guide structure 20 by coacting of key 294 on the guide arm unit with the drilling guide structure orientation member 75 and slot 76. The last part of the movement during this orientation is a downward movement as key 294 slides down slot 76. This allows casing support 299 to be received on casing 14 and the male stab-in connector 302 to be received in female stab-in member 57 on the drilling guide structure, as seen in FIG. 11. Then, connectors 303 and 304 are suitably actuated to release male connector members 300 and 301, freeing the flowline assembly 23 from the guide arm unit, which is then retrieved to the surface for subsequent flowline assemblies.

Once these steps are accomplished, the next sequence of events includes as shown in FIGS. 11 and 12, lowering along the handling and guiding string the wellhead guide arm unit 190 which is releasably carrying the wellhead 24. Upon landing the wellhead guide arm unit on the tubular member 42, the wellhead guide arm unit is oriented with the well casing 14 by coacting of the key 194 on the wellhead guide arm unit with the drilling guide structure orientation member 75 and slot 76. The last part of the movement during this orientation is a downward movement as key 194 slides down slot 76, thereby allowing the male stab-in connector 201 on flowline 200 to stab into the upwardly facing female stab-in connector 297 on the well casing 14 as seen in FIGS. 11 and 12. In addition, this movement allows the wellhead 24 to be coupled to the well casing 14 in the drilled well as shown in FIG. 12 wherein connector 197 on the well has been coupled to connector 198 on the wellhead casing.

Following this, the wellhead guide arm unit is released from the wellhead and retrieved to the surface and the steps of lowering, orienting, coupling and retrieving are repeated with additional wellheads for coupling to any desired additional wells.

Once all of the wellheads are in place, the production gathering assembly 26 is lowered along the handling and guiding string 46, the production gathering assembly having a plurality of flowline risers 28 and 29 extending upwardly therefrom and a plurality of flowline stab-in connectors 30 and 31 extending downwardly therefrom. The gathering assembly is lowered onto the drilling guide structure as shown in FIG. 12 at which time locator key 206 engages orientation member 75 to rotate the gathering assembly relative to the tubular member 42 and move it axially downwardly. The final part of this downward movement allows the male stab-in connectors 30 and 31 on the flowline risers 28 and 29 to connect with the upwardly facing female stab-in connectors 298 on the flowline assemblies, as shown in FIG. 1. This connection thereby couples the flowline risers to the wellheads via the male connectors 30 and 31, the female connectors 298, the flowlines 296, the connectors 297 and the vertically oriented flow lines 200 coupled to the wellheads.

The upwardly extending flowline risers 28 and 29 are then secured to the submerged buoy 32 and connected to the production vessel 38 via cross-over tubes 214 and 215, the female connector member 217, the male connector member 218, the catenary flowline bundle 34 and the single-point mooring buoy 36. At this time, the portion of the handling and guiding string 46 above the elongated tensioning buoy 48 can be removed and replaced by line 221 and marker buoy 222.

While one advantageous embodiment has been chosen to illustrate the invention, it will be understood by those skilled in the art that various changes and modifications can be made therein without departing from the scope of the invention as defined in the appended claims.

What is claimed is:

1. A method for remotely establishing an underwater well under conditions of great water depth, comprising the steps of installing at the floor of the body of water a generally upright support rigidly secured in the floor and projecting upwardly therefrom, lowering a drilling guide structure onto the upright support with a single handling string, vertically orienting the drilling guide structure relative to the water surface, locking the drilling guide structure to the upright support in the vertical position, lowering a drilling guide arm unit, carrying a drilling string and bit, along the single handling string onto the drilling guide structure, orienting the drilling bit to a desired well position by coacting the drilling guide arm unit with the drilling guide structure, drilling a well in the desired position with the drilling bit and installing well casing into the well, retrieving the drilling string, drilling bit and drilling guide arm unit to the surface, lowering a flowline guide arm unit, carrying a cross-over flowline assembly, along the single handling string onto the drilling guide structure, orienting the flowline assembly relative to the well casing and the drilling guide structure, by coacting the flowline guide arm unit with the drilling guide structure, landing the flowline assembly onto the well casing and the drilling guide structure, retrieving the flowline guide arm unit to the surface, lowering a wellhead guide arm unit, carrying a wellhead, along the single handling string onto the drilling guide structure, orienting the wellhead with the well casing and the flowline assembly by coacting the wellhead guide arm unit with the drilling guide structure, coupling the wellhead to the well casing and the flowline assembly, retrieving the wellhead guide arm unit to the surface, lowering a production gathering assembly, including a flowline riser extending upwardly therefrom with a connector extending downwardly therefrom, along the single handling string onto the drilling guide structure, orienting the production gathering assembly connector with the flowline assembly by coacting the gathering assembly with the drilling guide structure, and coupling the connector to the flowline assembly to provide a fluid-flow communication between the well casing and the flowline riser via the wellhead, flowline assembly, and connector.

2. A method according to claim 1 and further comprising the steps of repeating the second lowering, the orienting, the drilling and the retrieving steps for additional wells before the third lowering step.

3. A method according to claim 2, and further comprising the steps of repeating the third lowering, the orienting, the landing and the retrieving steps for additional flowline assemblies before the fourth lowering step.

4. A method according to claim 3, and further comprising the steps of repeating the fourth lowering, the orienting, the coupling and the retrieving steps for additional wellheads before the fifth lowering step.

5. A method according to claim 1, wherein the lowering steps include maintaining the single handling string in tension between the drilling guide structure and a location near but below the surface of the body of water.

6. A method according to claim 1, wherein each of the orientation steps include pivoting the guide arm unit and gathering assembly relative to the drilling guide structure.

7. A method according to claim 1, and further comprising the step of connecting the flowline riser to a production vessel at the surface of the body of water.

8. An apparatus for remotely establishing an underwater well under conditions of great water depth, the combination comprising:

a drilling guide structure rigidly secured at the floor of a body of water and having a generally tubular member extending upwardly thereform, said tubular member having a first orientation member on the outer surface thereof and a first connector member at the top thereof;

a single handling and guiding string extending through the water and having a second connector member at an end thereof coupled to said first connector member on said tubular member;

a well casing extending into the floor of the body of water;

a cross-over flowline assembly coupled to said well casing and to said guide structure, said flowline assembly having two upwardly facing flowline connectors at opposite ends;

a wellhead coupled in fluid-flow communication to said well casing and having a flowline connector coupled to one of said flowline connectors in said flowline assembly; and a production gathering assembly landed on said tubular member and having an open-ended member with a second orientation member on the inner surface thereof for engagement with said first orientation member when said production gathering assembly is so landed on said tubular member, said production gathering assembly having a flowline riser extending upwardly therefrom with a flowline connector extending downwardly therefrom and coupled to the other of said flowline connectors in said flowline assembly.

9. An apparatus according to claim 8, and further comprising an elongated buoy coupled to the other end of said single handling and guiding string to maintain said string in tension, said buoy being located near but below the surface of the body of water.

10. An apparaus according to claim 9, wherein said elongated buoy has a width less than the inner diameter of said open-ended member on said production gathering assembly so that said assembly can slide along said handling and guiding string past said elongated bouy.

11. An apparatus according to claim 8, and further comprising means for connecting said flowline riser to a production vessel at the surface of the body of water.

12. An apparatus according to claim 8, and further comprising a plurality of well casings extending into the floor of the body of water at desired locations spaced from said guide structure, a plurality of cross-over flowline assemblies, each coupled at one end to a well casing and at the other end to said guide structure and each having two upwardly facing flowline connectors at opposite ends, a plurality of wellheads, each coupled in fluid-flow communication to a well casing and having a flowline connector coupled to one of said flowline connectors in an associated flowline assembly, said production gathering assembly having a plurality of flowline risers for each wellhead with a plurality of flowline connectors extending downwardly therefrom and coupled to the other of said flowline connectors in an associated flowline assembly.

* * * * *